US011099503B2

(12) United States Patent
Mitsui et al.

(10) Patent No.: US 11,099,503 B2
(45) Date of Patent: Aug. 24, 2021

(54) IMAGE FORMING APPARATUS

(71) Applicant: CANON KABUSHIKI KAISHA, Tokyo (JP)

(72) Inventors: Yoshihiro Mitsui, Mishima (JP); Takuya Oka, Yokohama (JP); Yasukazu Ikami, Tokyo (JP); Shinichi Agata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/018,951

(22) Filed: Sep. 11, 2020

(65) Prior Publication Data

US 2021/0080873 A1 Mar. 18, 2021

(30) Foreign Application Priority Data

Sep. 17, 2019 (JP) ..... JP2019-168210
Jul. 28, 2020 (JP) ..... JP2020-127705

(51) Int. Cl.
*G03G 15/16* (2006.01)
*G03G 15/00* (2006.01)

(52) U.S. Cl.
CPC ..... *G03G 15/161* (2013.01); *G03G 15/70* (2013.01)

(58) Field of Classification Search
CPC ..... G03G 15/161; G03G 15/1615; G03G 15/5012; G03G 15/70; G03G 15/75; G03G 15/751
See application file for complete search history.

(56) References Cited

U.S. PATENT DOCUMENTS

2013/0336670 A1* 12/2013 Ikeda ..... G03G 15/161 399/66
2015/0104204 A1* 4/2015 Ishihara ..... G03G 15/1615 399/21
2019/0310570 A1* 10/2019 Konno ..... G03G 15/234
2020/0096914 A1* 3/2020 Watanabe ..... G03G 15/6514

FOREIGN PATENT DOCUMENTS

JP 2001-290328 A 10/2001
JP 2001-343779 A 12/2001
JP 2002-221879 A 8/2002
JP 2003-57906 A 2/2003
JP 2015-94897 A 5/2015

* cited by examiner

*Primary Examiner* — Carla J Therrien
(74) *Attorney, Agent, or Firm* — Canon U.S.A., Inc. I.P. Division

(57) ABSTRACT

An image forming apparatus includes a detection member configured to detect a conveyance state of a recording medium, a control unit configured to sequentially execute a first operation for continuously executing a rotation operation of an image bearing member and an intermediate transfer member without stopping them when the detection member detects a failure, and a second operation for stopping the rotation operation of the image bearing member when the surface of the image bearing member is moved by a predetermined distance through the rotation operation of the image bearing member after the failure is detected.

11 Claims, 8 Drawing Sheets

EXEMPLARY EMBODIMENT

COMPARATIVE EXAMPLE

SECOND EXEMPLARY EMBODIMENT

FIRST EXEMPLARY EMBODIMENT

IMAGE FORMING APPARATUS

BACKGROUND

Field

The present disclosure relates to an image forming apparatus, particularly relates to an electrophotographic image forming apparatus that forms an image on a recording medium by using an electrophotographic method.

Description of the Related Art

Conventionally, there has been provided a process cartridge that can be attached to and detached from a main body of an image forming apparatus. Further, the process cartridge has been provided with a waste toner box for collecting and storing "transfer residual toner" left on a photosensitive drum after a transfer operation, and "fog toner" existing in a non-image portion.

On the other hand, in recent years, as discussed in Japanese Patent Application Laid-Open No. 2015-94897 or Japanese Patent Application Laid-Open No. 2001-343779, reduction in capacity of a waste toner box included in the process cartridge has been considered because there has been an increased demand for a smaller process cartridge with increased capacity.

Specifically, in Japanese Patent Application Laid-Open No. 2015-94897, in order to reduce capacity of a waste toner box of a toner cartridge, occurrence of fog toner is reduced by arranging an alumina layer having the volume resistivity higher than that of a rubber layer on a surface of a development roller.

Further, in Japanese Patent Application Laid-Open No. 2001-343779, in order to reduce capacity of a waste toner box of a process cartridge, an amount of waste toner such as "transfer residual toner" and "fog toner" is reduced by optimizing developer and a development processing condition.

However, the configurations discussed in Japanese Patent Application Laid-Open No. 2015-94897 and Japanese Patent Application Laid-Open No. 2001-343779 still have some points that can be improved. Specifically, for example, in a case where a sheet jam (hereinafter, referred to as "jam") occurs in a printer, a large amount of jam toner that is moved to a photosensitive drum but cannot be transferred to a sheet is collected and stored in a waste toner box of a process cartridge. Thus, in Japanese Patent Application Laid-Open No. 2015-94897 and Japanese Patent Application Laid-Open No. 2001-343779, in order to deal with a sudden event such as "jam" or a jam recovery operation, a certain amount of capacity has to be previously secured for the waste toner box of the process cartridge. Accordingly, the waste toner box provided in the process cartridge cannot be minimized sufficiently.

SUMMARY

The present disclosure is directed to an image forming apparatus capable of minimizing capacity of a developer collection box provided in a cartridge while improving a jam recovery efficiency.

According to an aspect of the present disclosure, an image forming apparatus includes an image bearing member configured to be rotatable and to bear a developer image developed from an electrostatic latent image on a surface of the image bearing member, a developer bearing member, which is configured to bear developer to be supplied to the image bearing member for developing the electrostatic latent image, and which is configured to be abutable on the image bearing member, an exposure member configured to emit light for exposing the surface of the image bearing member, an intermediate transfer member configured to be rotatable, to contact the surface of the image bearing member, and to bear the developer image transferred from the image bearing member, a cleaning member configured to clean a surface of the intermediate transfer member, a secondary transfer member configured to secondarily transfer the developer image to a recording medium for recording the developer image, from the intermediate transfer member, a fixing member configured to fix the developer image transferred to the recording medium by the secondary transfer member, a detection member configured to detect a conveyance state of the recording medium, and a control unit, wherein, when the detection member detects a failure in the conveyance state of the recording medium, the control unit executes a first operation for continuously executing a rotation operation of the image bearing member and the intermediate transfer member without stopping the rotation operation of either member and, when the surface of the image bearing member is moved by a predetermined distance through the rotation operation of the image bearing member after the failure is detected, the control unit then executes a second operation for stopping the rotation operation of the image bearing member, wherein, in the first operation, a fixing operation of the fixing member is stopped, and the predetermined distance is longer than or equal to a length of the surface of the image bearing member in a rotation direction of the image bearing member, between a development position that contacts the developer bearing member and a transfer position that contacts the intermediate transfer member, and is shorter than or equal to a distance by which the surface of the image bearing member is moved in a period when the recording medium is moved from a secondary transfer position of the secondary transfer member to a fixing position of the fixing member.

Further features of the present disclosure will become apparent from the following description of exemplary embodiments with reference to the attached drawings.

DESCRIPTION OF THE EMBODIMENTS

An electrophotographic image forming apparatus according to the present disclosure will be described with reference to the appended drawings. The exemplary embodiments described below are merely examples illustratively describing the present disclosure, and a scope of the present disclosure is not limited to sizes, materials, shapes and a relative positional relationship of the constituent elements described below unless such specific limitations are described in particular.

In the present disclosure, the electrophotographic image forming apparatus is an apparatus that forms an image on a recording medium by using an electrophotographic image forming method. Examples of the electrophotographic image forming apparatus include an electrophotographic copying machine, an electrophotographic printer (e.g., laser beam printer and light-emitting diode (LED) printer), a facsimile machine, and a word processor.

A process cartridge that constitutes a part of the image forming apparatus is a cartridge in which a charging unit, a development unit (or a cleaning unit), and an electrophotographic photosensitive drum are integrated into a form of a cartridge and that can be attached to and detached from a main body of the electrophotographic image forming apparatus. Further, a process cartridge is configured of at least any one of a charging unit, a development unit, and a cleaning unit, or an electrophotographic photosensitive drum, integrated into a form of a cartridge that can be attached to and detached from a main body of the electrophotographic image forming apparatus. Further, a process cartridge is a cartridge in which at least a development unit or an electrophotographic photosensitive drum are integrated into a form of a cartridge and that can be attached to and detached from a main body of the electrophotographic image forming apparatus.

A configuration and an image forming process of an electrophotographic image forming apparatus (hereinafter, referred to as "image forming apparatus") according to exemplary embodiments of the present disclosure will be described with reference to the drawings.

An overall configuration of the image forming apparatus, a configuration of the process cartridge, and a configuration to be a feature of the present disclosure according to a first exemplary embodiment of the present disclosure will be described with reference to FIGS. 1 to 5B.

<General Configuration of Image Forming Apparatus>

Hereinafter, an overall configuration of an electrophotographic image forming apparatus (image forming apparatus) as one exemplary embodiment of the present disclosure will be described.

Figure 1:
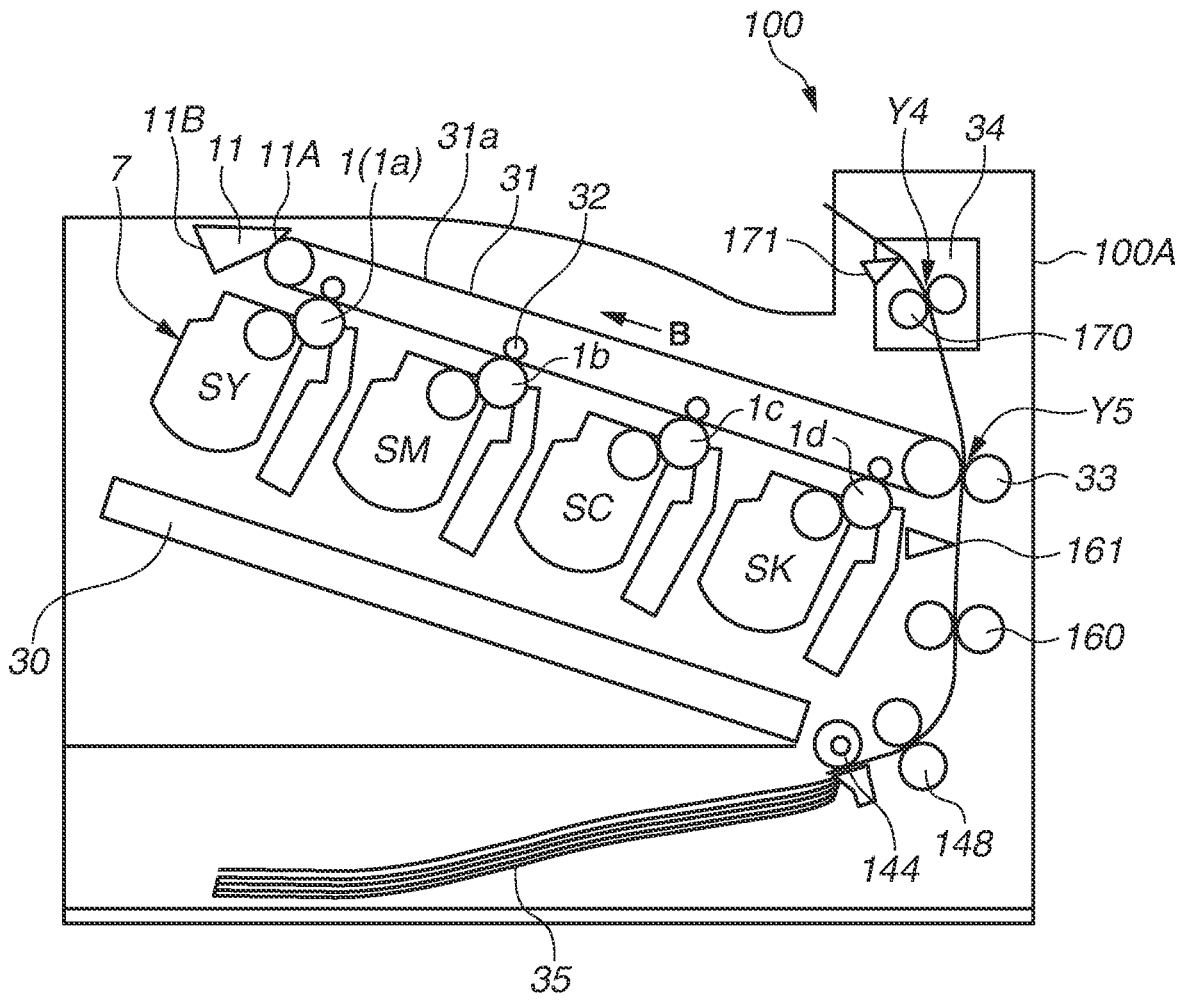
FIG. 1 is a conceptual cross-sectional diagram of an image forming apparatus according to a first exemplary embodiment of the present disclosure.

FIG. 1 is a conceptual cross-sectional diagram of an image forming apparatus according to the first exemplary embodiment of the present disclosure.

As illustrated in FIG. 1, an image forming apparatus 100 according to the present exemplary embodiment is a full-color laser beam printer employing an intermediate transfer method. Based on image information, the image forming apparatus 100 can form a full color image on a recording material 35 such as a recording sheet, a plastic sheet, or a fabric by using toner (developer) 80. The image information is input to an image forming apparatus main body 100A through an image reading apparatus connected to the image forming apparatus main body 100A or a host device such as a personal computer communicably connected to the image forming apparatus main body 100A.

The image forming apparatus 100 includes process cartridges 7 serving as a plurality of image forming units SY, SM, SC, and SK for forming images of respective colors of yellow (Y), magenta (M), cyan (C), and black (K).

Each of the process cartridges 7 can be attached to and detached from the image forming apparatus 100 via an attachment unit such as an attachment guide or a positioning member arranged on the image forming apparatus main body 100A. In the present exemplary embodiment, the process cartridges 7 of respective colors have a same shape, and store toner (developer)80 of respective colors of yellow (Y), magenta (M), cyan (C), and black (K).

An exposure device 30 (exposure member) configured of a scanner unit is arranged in a periphery of a photosensitive drum 1 (image bearing member) (i.e., photosensitive drums 1*a*, 1*b*, 1*c*, and 1*d*). The exposure device 30 emits laser light based on image information and forms an electrostatic image (electrostatic latent image T0) on the photosensitive drum 1. In a main scanning direction, i.e., a direction orthogonal to a sheet conveyance direction, laser-exposure scanning is started for each scanning line based on a position signal generated by a beam detector (BD) within a polygon scanner. On the other hand, in a sub-scanning direction, i.e., the sheet conveyance direction, laser-exposer scanning is executed with delay of a predetermined time from a ToP signal generated by a switch (not illustrated) within a sheet material conveyance path as a starting point. With this configuration, in each of four process stations Y, M, C, and Bk, laser exposure is consistently executed at the same position (exposure position Y1) of the photosensitive drum 1.

An intermediate transfer belt 31 serving as an intermediate transfer member for transferring toner images (developer images T) formed on the photosensitive drums 1 to a recording material 35 is arranged to face the four photosensitive drums 1, respectively. The intermediate transfer belt 31 formed of an endless belt, serving as an intermediate transfer member, abuts on all of the photosensitive drums 1 and rotationally moves (rotates) in a direction (counterclockwise direction) indicated by an arrow B in FIG. 1. The abutting position of the photosensitive drum 1 and the intermediate transfer belt 31 is a transfer position Y2 described below.

On a side of the inner circumferential surface of the intermediate transfer belt 31, four primary transfer rollers 32 as primary transfer units are arranged in juxtaposition to face the respective photosensitive drums 1 (1*a* to 1*d*). Bias having a polarity opposite to a normal charging polarity of toner is applied to the primary transfer roller 32 from a primary transfer bias power source (high-voltage power source) as a primary transfer bias application unit (not illustrated). This operation causes the toner images on the photosensitive drums 1 to be transferred (primarily transferred) to an outer circumferential surface 31*a* of the intermediate transfer belt 31 (intermediate transfer member) at the transfer position Y2.

Further, a secondary transfer roller 33 serving as a secondary transfer unit is arranged on a side of the outer circumferential surface 31*a* of the intermediate transfer belt 31. Bias of a polarity opposite to the normal charging polarity of toner is applied to the secondary transfer roller 33 from a secondary transfer bias power source (high-voltage power source) as a secondary transfer bias application unit (not illustrated). This operation causes the toner images on the intermediate transfer belt 31 to be transferred (secondarily transferred) to the recording material 35. For example, when a full-color image is to be formed, the above-described process is sequentially executed at the image forming units SY, SM, SC, and SK, so that toner images of respective colors are sequentially overlapped and primarily transferred to the intermediate transfer belt 31.

As a conveyance unit for conveying the recording material 35 to a secondary transfer portion, the image forming apparatus 100 includes a pick-up roller 144, a conveyance roller 148, and a registration roller 160. The recording material 35 is fed by the pick-up roller 144 at a predetermined timing from a start of exposure. Thereafter, the recording material 35 is conveyed by the conveyance roller 148 and the registration roller 160. When a leading edge of the recording material 35 is detected by a sheet detection sensor 161, the conveyance roller 148 and the registration roller 160 are stopped temporarily and brought into a stand-by state. Then, a driving operation of the conveyance roller 148 and the registration roller 160 is restarted at a predetermined timing. Then, the recording material 35 that is in a stand-by state is moved and conveyed to the secondary transfer portion. The sheet detection sensor 161 is connected to a detection member D described below, and outputs a signal to the detection member D.

By feeding and refeeding a sheet at a predetermined timing from the start of exposure, the toner image on the intermediate transfer belt 31 overlaps with the recording material 35 at a good timing at the secondary transfer portion, so that the toner image is secondarily transferred to the recording material 35 without misregistration.

The recording material 35 on which the toner image is transferred is conveyed to a fixing device (fixing member) 34 serving as a fixing unit. The fixing device 34 applies heat and pressure to the recording material 35, so that the toner image is fixed to the recording material 35.

Transfer residual toner left on the intermediate transfer belt 31 after the secondary transfer operation is collected by a cleaning member 11A for the intermediate transfer belt 31 and stored in a toner collection box 11B (developer collection box).

<Control System of Image Forming Apparatus>

Next, a control system of the image forming apparatus 100 will be described.

Figure 2:
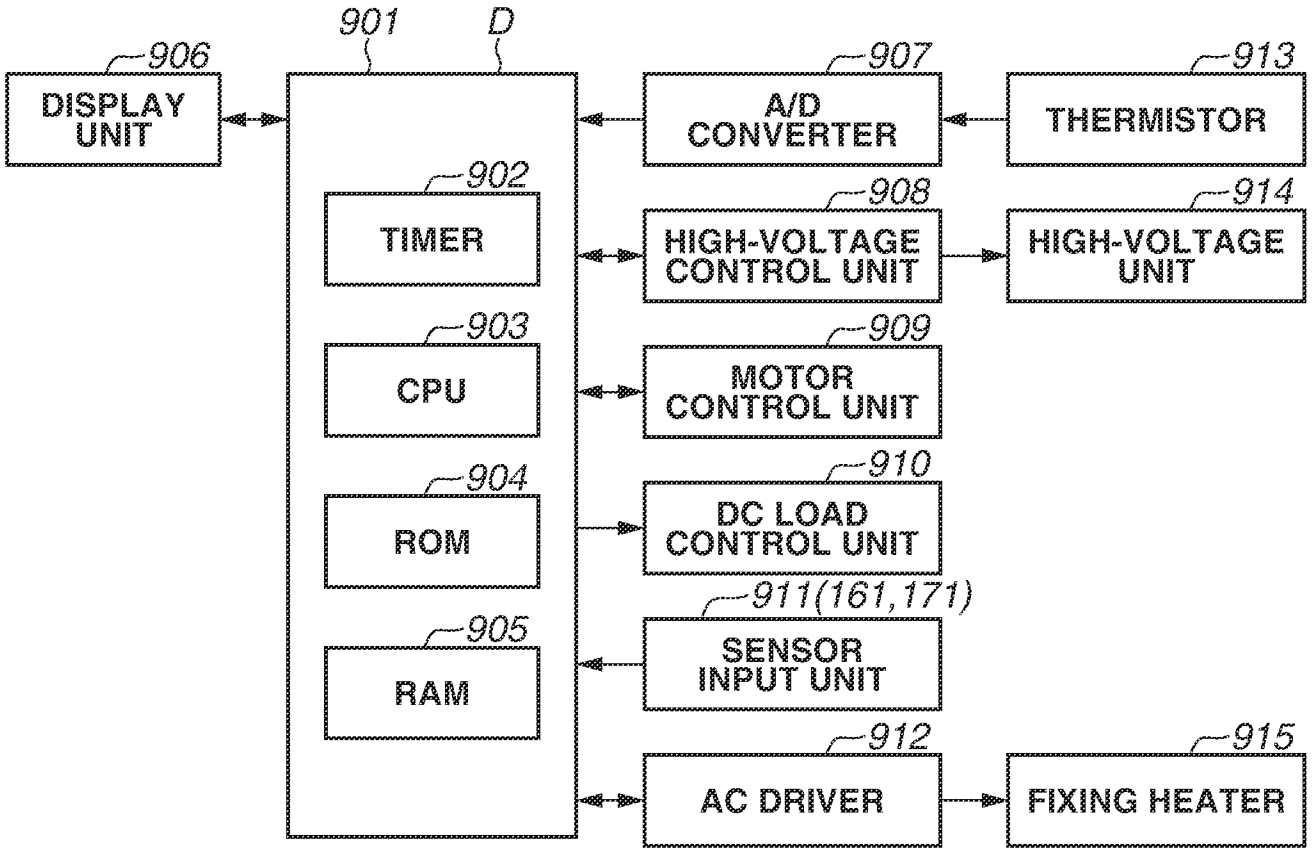
FIG. 2 is a control block diagram of the image forming apparatus according to the first exemplary embodiment of the present disclosure.

FIG. 2 is a control block diagram of the image forming apparatus 100 according to the present exemplary embodiment of the present disclosure.

As illustrated in FIG. 2, all of the processing executed by the image forming apparatus 100 is collectively controlled by a system controller 901. The system controller 901 (control unit) mainly plays a role for driving a load within the image forming apparatus 100, collecting and analyzing information from sensors, and exchanging data with a user interface such as a display unit 906. The system controller 901 includes a central processing unit (CPU) 903 in order to play the above-described role. The CPU 903 executes various sequences relating to predetermined image formation through a program stored in a read only memory (ROM) 904 also mounted on the system controller 901. The system controller 901 also includes a random access memory (RAM) 905, so that data that has to be saved temporarily or permanently is stored therein. A high-voltage setting value for a high-voltage control unit 908, various kinds of data, and information about an image forming instruction received via the display unit 906 are saved in the RAM 905.

The system controller 901 acquires information about a printing condition and a density setting value set by a user from the display unit 906. On the other hand, the system controller 901 transmits information about a state of the image forming apparatus 100 to the display unit 906. For example, this information includes the number of sheets on which image formation is executed, an execution/non-execution state of image formation, and data indicating occurrence of a jam or a place of the occurrence of jam to the user.

The image forming apparatus 100 of the present exemplary embodiment includes motors, direct-current (DC) loads such as clutches or solenoids, and sensors such as photo-interrupters arranged on respective portions within the image forming apparatus 100. In other words, conveyance of a recording medium and driving of various units are executed by appropriately driving the motors and the DC loads, and the operation thereof is monitored by the various sensors.

With this configuration, the system controller 901 detects signals from the various sensors by a sensor input unit 911, and stops or drives the respective motors through a motor control unit 909 based on the signals. The motor control unit 909 also controls an abutting/separation operation of the intermediate transfer belt (intermediate transfer member) 31 and the photosensitive drum 1 and an abutting/separation operation of the development roller 17 and the photosensitive drum 1.

At the same time, the system controller 901 causes the DC load control unit 910 to operate the clutches and solenoids to smoothly execute the image forming operation. Further, by transmitting various high-voltage control signals to the high-voltage control unit 908, appropriate high voltage is applied to a charging roller, a development roller, a primary transfer roller, and a secondary transfer roller, which constitute a high-voltage unit 914.

Further, a fixing heater 915 as a heating member is built in the fixing device 34, and controlled to be turned ON and OFF by an alternate-current (AC) driver 912. Further, the fixing heater 915 includes a thermistor 913 as a temperature detection member for measuring a temperature thereof. A change of a resistance value of the thermistor 913 corresponding to a change amount of a temperature of the fixing heater 915 is converted into a voltage value by an analog-to-digital (A/D) converter 907. Then, this value is input to the system controller 901 as a digital value. The above-described AC driver 912 is controlled based on this temperature data.

<Configuration of Process Cartridge>

Next, an overall configuration of the process cartridge 7 attached to the image forming apparatus 100 according to the present exemplary embodiment will be described with reference to FIGS. 3A to 3D.

Figure 3A:
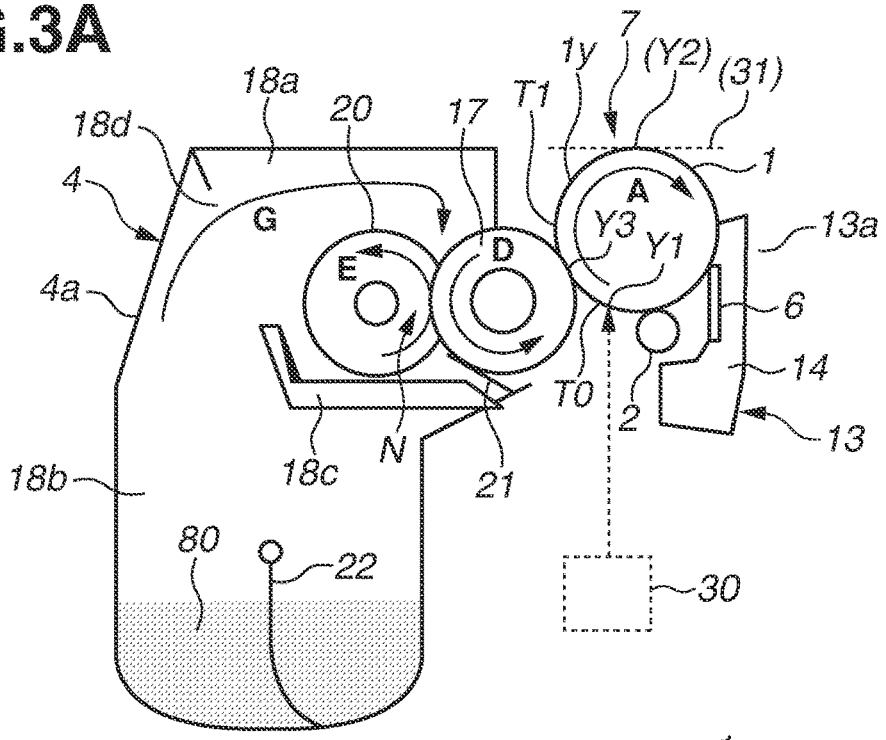
FIG. 3A is a conceptual cross-sectional diagram of a process cartridge used for the image forming apparatus according to the first exemplary embodiment of the present disclosure.
Figure 3B:
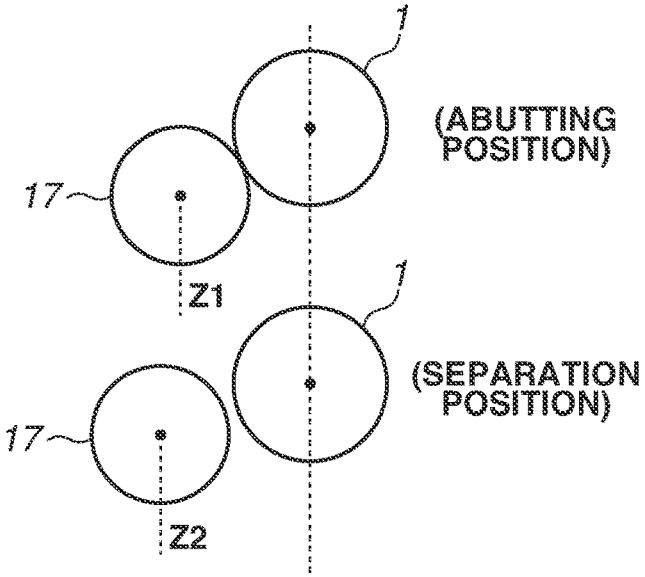
FIG. 3B is a conceptual diagram illustrating an abutting position and a separation position of the process cartridge.
Figure 3C:
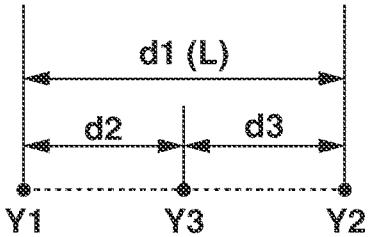
FIG. 3C is a schematic diagram illustrating a predetermined distance L.
Figure 3D:
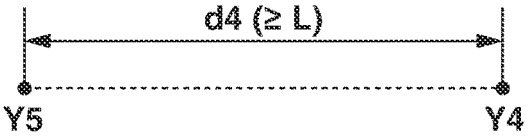
FIG. 3D is a schematic diagram illustrating a maximum value of the predetermined distance L.

FIG. 3A is a conceptual cross-sectional diagram of the process cartridge 7 used for the image forming apparatus 100 according to the present exemplary embodiment of the present disclosure. FIG. 3B is a conceptual diagram illustrating an abutting position and a separation position of the process cartridge 7. Further, FIG. 3C is a schematic diagram illustrating a predetermined distance L, and FIG. 3D is a schematic diagram illustrating a maximum value of the predetermined distance L. In the present exemplary embodiment, configurations and operations of the process cartridges 7 of respective colors are practically the same except for types (colors) of toner stored therein.

The process cartridge 7 viewed in a lengthwise direction (rotation axis line direction) of the photosensitive drum 1 is illustrated in FIG. 3A. In FIG. 3A, the process cartridge 7 is illustrated in an orientation in which the process cartridge 7 is attached to the image forming apparatus main body 100A. Hereinafter, a positional relationship or a direction of each member of the process cartridge 7 is described based on the orientation and the positional relationship illustrated in FIG. 3A.

In the present exemplary embodiment, the process cartridge 7 is integrally configured of a photosensitive unit 13 including the photosensitive drum 1 (image bearing member) and a development unit 4 including the development roller 17 (developer bearing member).

The photosensitive unit 13 includes a cleaning frame member (first frame member) 13*a* as a frame member that supports various elements of the photosensitive unit 13. The photosensitive drum 1 is rotatably attached to the cleaning frame member 13*a* via a shaft bearing (not illustrated). A driving force of a driving motor (not illustrated) as a driving unit (driving source) is transmitted to the photosensitive unit 13, so that the photosensitive drum 1 is rotationally driven in a direction indicated by an arrow A (clockwise direction) corresponding to an image forming operation.

In the present exemplary embodiment, an organic photosensitive drum is used as the photosensitive drum 1, which plays a central role of the image forming operation. The (organic) photosensitive drum 1 is configured of an aluminum cylinder, of which outer circumferential face thereof is coated with an under coat layer, a carrier generation layer, and a carrier transfer layer serving as functional films in this order.

Further, a cleaning member 6 (second cleaning member) and a charging roller 2 are arranged on the photosensitive unit 13, so as to be in contact with the circumferential face of the photosensitive drum 1. Transfer residual toner removed from the surface of the photosensitive drum 1 by the cleaning member 6 falls and is stored in the toner collection box (developer collection chamber) 14 formed inside the cleaning frame member 13*a*.

The charging roller 2 serving as a charging unit is rotated by causing a roller portion made of conductive rubber to press and contact the photosensitive drum 1.

In the charging processing, a predetermined direct current voltage to the photosensitive drum 1 is applied to a core metal of the charging roller 2, so that a uniform dark portion potential (Vd) is formed on a surface of the photosensitive drum 1. When the photosensitive drum 1 is exposed to a laser beam having a spot pattern, emitted corresponding to image data from the above-described exposure device 30, electric charges of a surface of the exposed portion is lost by a carrier generated from the carrier generation layer, and a potential thereat is lowered. As a result, an electrostatic latent image consists of an exposed portion with a predetermined light portion potential (Vl) and a non-exposed portion with a predetermined dark portion potential (Vd) is formed on the photosensitive drum 1. In the present exemplary embodiment, the dark portion potential Vd and the light portion potential V are −500V and −100V, respectively.

The development unit 4 includes a frame member (second frame member) 4*a* and a development chamber 18*a* in which a development roller 17 as a developer bearing member for bearing toner 80 and a toner supply roller 20 as a supply member for supplying toner to the development roller 17 are arranged. Further, the frame member (second frame member) 4*a* of the development unit 4 includes a toner storage chamber (developer storage chamber) 18*b* for storing toner, and the toner storage chamber 18*b* is positioned on a lower side of the toner supply roller 20 in the gravitational direction. The development chamber 18*a* and the toner storage chamber 18*b* are formed of an inner space of the frame member 4*a* by a partition portion 18*c* partitioning the inner space thereof, and communicate with each other via an opening 18*d*.

Further, the toner supply roller 20 and the development roller 17 rotate in a state where a toner nip portion N (portion where toner is nipped between the development roller 17 and the toner supply roller 20) is formed therebetween.

An agitation conveyance member 22 is arranged inside the toner storage chamber 18*b*. The agitation conveyance member 22 agitates toner stored in the toner storage chamber 18*b* and conveys the toner toward the upper portion of the toner supply roller 20 in a direction indicated by an arrow G in FIG. 3A.

A development blade 21 is arranged on the lower side of the development roller 17, and faces and abuts on the development roller 17. The development blade 21 regulates a coating amount of toner supplied from the toner supply roller 20 and applies an electric charge thereto. In the present exemplary embodiment, a thin plate made of Steel-Use-Stainless (SUS), formed into a plate spring having a thickness of 0.1 mm, is used as the development blade 21, and a surface thereof abuts on toner and the development roller 17 because of abutting pressure generated from a spring elastic force of the thin plate. However, a material of the development blade 21 is not limited thereto, and a metallic thin plate made of phosphor bronze or aluminum can be also used. Further, a surface of the development blade 21 may be covered with a thin film made of a material such as polyamide elastomer, urethane rubber, or urethane resin.

Toner is frictionally charged because of friction between the development blade 21 and the development roller 17, and a layer thickness thereof is also regulated simultaneously. Further, in the present exemplary embodiment, in order to stabilize the toner coating, a predetermined voltage is applied to the development blade 21 from a blade bias power source (not illustrated). In the present exemplary embodiment, as the blade bias, −500V is applied to the development blade 21.

The development roller 17 and the photosensitive drum 1 rotate in such a manner that respective surfaces are moved in a same direction (in the present exemplary embodiment, a direction from bottom to top) at the confronting position.

In the present exemplary embodiment, the development roller 17 is arranged to be in contact with the photosensitive drum 1. However, the development roller 17 may be arranged close to the photosensitive drum 1 with a predetermined space therebetween.

In the present exemplary embodiment, toner is charged by frictional electrification in a negative polarity relative to a predetermined DC bias voltage applied to the development roller 17. At a development portion (development position Y3) where the development roller 17 is in contact with the photosensitive drum 1, because of a potential difference, this charged toner is transferred to only a portion in a light portion potential, and an electrostatic latent image is visualized. In the present exemplary embodiment, a potential difference ΔV of 200V with the portion in a light portion potential is generated by applying −300V to the development roller 17, and a toner image is formed thereon.

The toner supply roller 20 is an elastic sponge roller configured of a conductive core metal with a foam layer formed on an outer circumferential face thereof. As illustrated in FIG. 3A, the toner supply roller 20 is in contact with the development roller 17 with a predetermined intrusion amount, i.e., a concave amount ΔE by which the toner supply roller 20 is concaved by the development roller 17. At a nip portion N, each of the toner supply roller 20 and the development roller 17 rotates in the opposite direction at a different circumferential speed. With this operation, the toner supply roller 20 supplies toner to the development roller 17.

<Operation Executed when Jam Occurs>

Next, the operation control according to the present exemplary embodiment, executed when a recording medium jam occurs, will be described with reference to FIG. 4.

Figure 4:
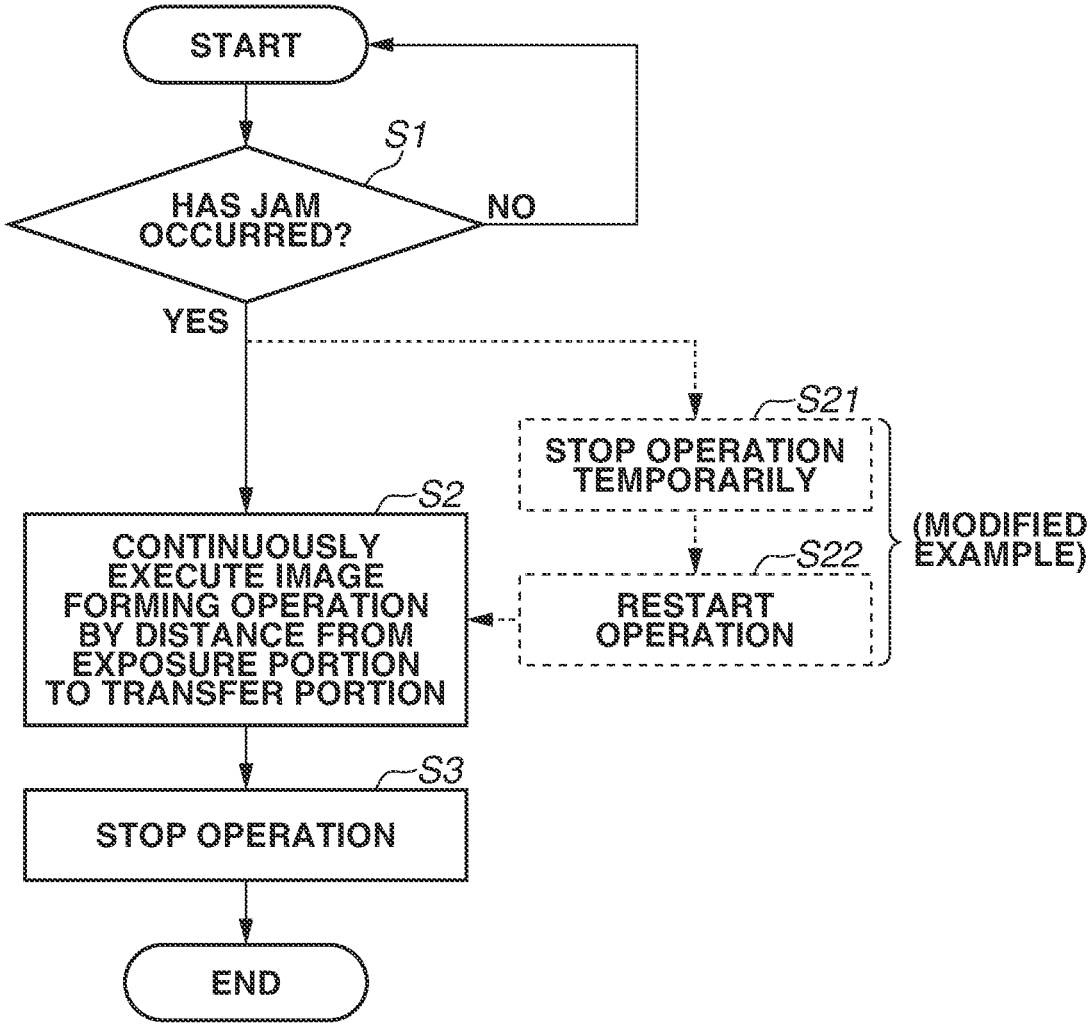
FIG. 4 is a flowchart illustrating control processing executed when a jam occurs in the image forming apparatus according to the first exemplary embodiment of the present disclosure.

FIG. 4 is a flowchart illustrating control processing executed when a jam occurs in the image forming apparatus 100 according to the present exemplary embodiment of the present disclosure.

The image forming apparatus 100 according to the present exemplary embodiment includes a fixing motor (not illustrated) for rotating a fixing roller 170 of the fixing device 34 and a belt motor (not illustrated) for rotationally driving the intermediate transfer belt 31. The image forming apparatus 100 further includes a cartridge driving motor (not illustrated) capable of rotationally and individually driving the photosensitive unit 13 and the development unit 4 of the process cartridge 7.

The system controller 901 (control unit) can drive or stop these motors by transmitting a control signal to the motor control unit 909. Further, the system controller 901 inputs signals output from various sensors such as a fixing discharge sensor 171 and a sheet detection sensor 161 to the detection member D via the sensor input unit 911 to detect a conveyance failure (i.e., jam). In other words, the system controller 901 includes a conveyance failure detection unit (detection member D) capable of detecting (specifying) a position where a jam occurs in the image forming apparatus 100.

While image formation is being executed, the system controller 901 constantly and continuously monitors occurrence of a jam.

As illustrated in FIG. 4, in the present exemplary embodiment, in the jam detection processing in step S1, if the detection member D of the system controller 901 detects occurrence of a jam while the image forming operation is being executed (YES in step S1), the processing proceeds to step S2.

In step S2, the system controller 901 (control unit) firstly stops the exposure operation executed by the exposure device 30. At the same time, the system controller 901 continuously rotates and drives the process cartridge 7, the intermediate transfer belt 31, and the secondary transfer roller 33 for a predetermined period without stopping them.

This predetermined duration period corresponds to a distance d1 (in the present exemplary embodiment, d1=45 mm) equivalent to a predetermined distance L between (from) the exposure portion (exposure position Y1) and (to) the transfer portion (transfer position Y2) on a moving path of an electrostatic latent image or a toner image. In other words, the predetermined duration period is a time necessary to rotate and move the surface of the photosensitive drum 1 by the predetermined distance L.

Then, in step S3, when a predetermined time has passed (i.e., when a surface of the photosensitive drum 1 is moved by a predetermined distance L) after detecting occurrence of the jam, the system controller 901 stops the image forming operation of the image forming apparatus 100. Specifically, in step S3, the system controller 901 stops the operation of the process cartridge 7, the intermediate transfer belt 31, and the secondary transfer roller 33 (i.e., operation relating to image formation) included in the image forming apparatus 100.

Further, in step S2, caused by the fixing operation executed by the fixing device 34 (fixing member), a sheet may wind around a fixing roller to cause a so-called sheet winding jam to occur. In order to prevent occurrence of this type of issue, after the jam is detected in the jam detection processing in step S1, in step S2, the fixing operation of the fixing device 34 may be stopped previously.

Next, a transition state of developer caused by the processing after occurrence of a jam (i.e., the operation in step S2) of the present exemplary embodiment will be described with reference to FIGS. 5A and 5B.

The present exemplary embodiment will be described by making a comparison with a comparative example in which the image forming operation of the image forming apparatus 100 is promptly stopped after occurrence of a jam without executing the first operation in step S2.

Figure 5A:
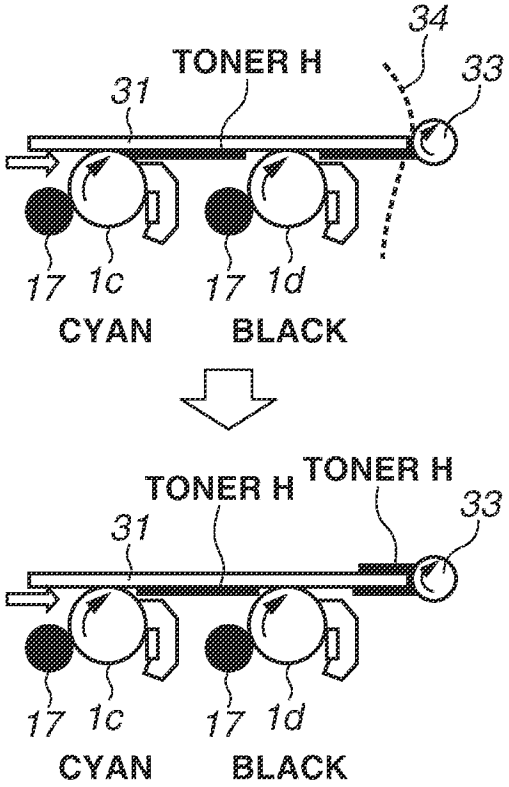
FIGS. 5A and 5B are schematic diagrams respectively illustrating transition states of developer in the image forming apparatus according to the first exemplary embodiment and a comparative example of the present disclosure.

FIG. 5A is a schematic diagram illustrating a transfer state of developer in the image forming apparatus 100 according to the present exemplary embodiment of the present disclosure. FIG. 5B is a schematic diagram illustrating a transfer state of developer in a comparative example.

Figure 5B:
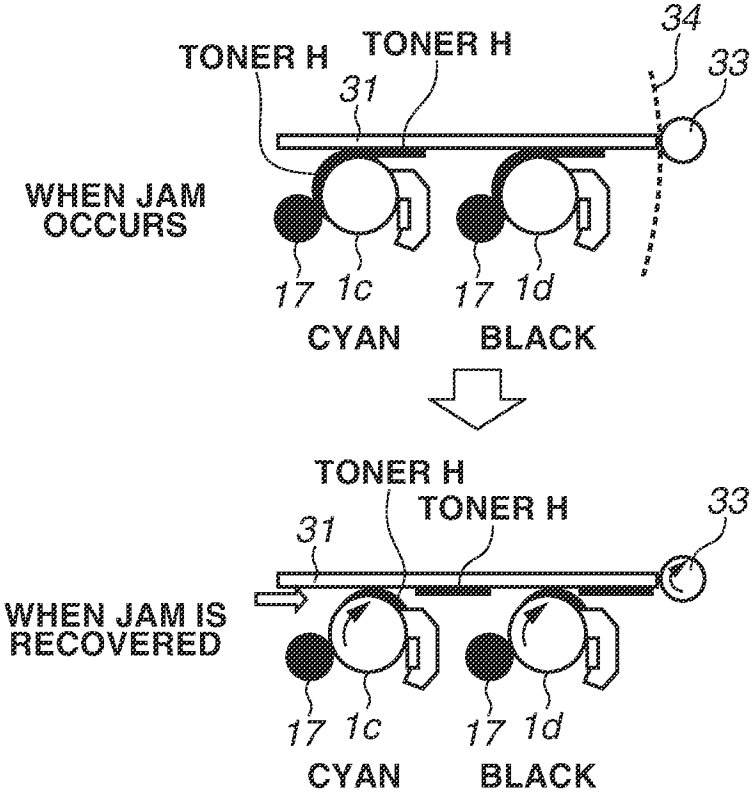

Specifically, each of FIGS. 5A and 5B illustrates a state of developer adhering to and stagnating in the respective members of the third station (cyan) and the fourth station (black) of the image forming apparatus 100.

As illustrated in FIG. 5B, in the comparative example, when occurrence of a jam is detected, the driving operation is stopped promptly, and various biases are switched to OFF to stop the image forming operation. Therefore, developed jam toner H transferred to the photosensitive drum 1 is left as it is.

In other words, in the comparative example, if the toner H is not collected from the photosensitive drum 1 immediately after occurrence of the jam, the electric charge caused by frictional electrification retained by the toner H is attenuated. For this reason, the toner H on the photosensitive drum 1 cannot be removed or retransferred easily when a jam recovery operation is executed, so that the toner H has to be collected into the toner collection box 14 of the process cartridge 7. Thus, in the comparative example, the jam toner H on the photosensitive drum 1 cannot be collected into the cleaning device (toner collection box 11B) of the intermediate transfer belt 31 by transferring the toner H to the intermediate transfer belt 31.

On the other hand, in the present exemplary embodiment, as illustrated in FIG. 5A, when occurrence of a jam is detected, driving of the photosensitive drum 1 is not stopped. Accordingly, the photosensitive drum 1 can be stopped after the toner H developed on (transferred to) the photosensitive drum 1 is completely moved (for example, is transferred) to the intermediate transfer belt 31. Accordingly, when the jam recovery operation is executed, the toner H on the photosensitive drum 1 has already been moved to the intermediate transfer belt 31. Therefore, a large amount of toner H left on the photosensitive drum 1 at the time of occurrence of a jam does not have to be collected into the toner collection box 14 of the process cartridge 7.

More specifically, in the present exemplary embodiment, the exposure operation is stopped after occurrence of a jam is detected. Then, the image forming operation (driving operation) is extended (continued) by a distance that is a sum of the distance d2 from the development portion (development position Y3) to the transfer portion (transfer position Y2) and the distance d3 from the exposure portion (exposure position Y1) to the development portion (development position Y3), i.e., a distance corresponding to the distance d1 (d1=d2+d3).

In this way, in step S2, charged developer (jam toner H) on the development roller 17 corresponding to a latent image portion that has not been developed on (transferred to) the photosensitive drum 1 at the time of occurrence of a jam can be sufficiently developed on (transferred to) the photosensitive drum 1. Further, the developer can be transferred to the intermediate transfer belt 31 from the photosensitive drum 1.

Therefore, it is possible to prevent developer (jam toner H) from being collected to the toner collection box 14 of the process cartridge 7 when the jam recovery operation is executed. As a result, capacity necessary for collecting the jam toner H does not have to be secured in the process cartridge 7, so that the jam can be recovered effectively, and the capacity of the toner collection box 14 of the process cartridge 7 can be minimized further.

In step S2 of the present exemplary embodiment, a driving operation (image forming operation) of the process cartridge 7, the intermediate transfer belt 31, and the secondary transfer roller 33 is continuously executed by the predetermined distance L described above. Further, as described above, the predetermined distance L is equivalent to the distance d1 from the exposure portion (exposure position Y1) to the transfer portion (transfer position Y2) (d1=d2+d3). In the present exemplary embodiment, the operation of the fixing roller 170 is stopped when the operation in step S2 is executed.

In this way, worsening of the sheet winding jam can be prevented efficiently even if the sheet winding jam described above occurs in the fixing roller 170. Therefore, a collectable toner amount (i.e., capacity) of the toner collection box 14 of the process cartridge 7 can be minimized, and worsening of the sheet winding jam occurring at the fixing roller 170 can be reduced. In this case, the recording material 35 conveyed inside the image forming apparatus 100 may be warped moderately. However, this will not affect the jam recovery operation.

Next, an upper limit of the predetermined distance L will be considered with respect to the case where the operation of the fixing roller 170 of the image forming apparatus 100 is stopped in step S2 immediately after occurrence of a jam is detected. For example, as an experimental example, in a case where the predetermined distance L is set to exceed a distance d4 from the secondary transfer position Y5 to the fixing position Y4 (in the present exemplary embodiment, d4=120 mm), the following phenomenon may occur. More specifically, unfixed toner areas in an image on one recording material 35 are likely to be in contact with each other because of a bend occurring in that recording material 35. As a result, occurrence of the jam may further bring a sense of discomfort to the user.

More specifically, in step S2, if the image forming operation is continuously executed for a distance longer than or equal to the distance between the nip portion (fixing position Y4) of the fixing roller 170 and the nip portion (secondary transfer position Y5) of the secondary transfer roller 33 after the jam is detected, the above-described phenomenon, i.e., contact between unfixed toner areas, is likely to occur. From this viewpoint, a distance that is shorter than or equal to the distance d4 from the secondary transfer position Y5 to the fixing position Y4 can be set as an upper limit (maximum value) of the distance L (d4≥L) in step S2.

In other words, in the present exemplary embodiment, the predetermined distance L is longer than or equal to a length of a surface 1*y* of the photosensitive drum 1 in a rotation direction A of the photosensitive drum 1, between (from) the exposure position Y1 on the surface 1*y* of the photosensitive drum 1 (image bearing member), at which exposure is executed by the exposure device 30 (exposure member), and (to) the transfer position Y2 that is in contact with the intermediate transfer belt 31 (intermediate transfer member), and is shorter than or equal to a distance by which the surface 1*y* of the photosensitive drum 1 is moved in a period during which a recording medium is moved from the secondary transfer position Y5 in the secondary transfer roller 33 (secondary transfer member) to the fixing position Y4 in the fixing device 34 (fixing member).

By setting a value of the predetermined distance L within the above-described range, capacity of the developer collection box provided in the process cartridge 7 can be minimized, and the jam can be recovered efficiently. Particularly, a sense of discomfort felt by the user because of occurrence of a jam can be reduced effectively.

Further, in the present exemplary embodiment illustrated in FIG. 5A, when the jam recovery operation is executed, transfer bias is not applied in a state where the photosensitive drum 1 is in contact with the intermediate transfer belt 31. However, the transfer bias may be applied thereto in order to reduce the amount of toner transferred to the photosensitive drum 1 from the intermediate transfer belt 31.

Modified Example of The First Exemplary Embodiment

Further, in the present exemplary embodiment, the system controller 901 stops the laser exposure operation and continuously executes the image forming operation in step S2 after a jam is detected by the detection member D in step S1. However, as one variation example, the system controller 901 may temporarily stop the image forming operation in step S21 after detecting the jam in step S1, and may execute control in step S2 described in the present exemplary embodiment immediately after step S21. In other words, processing for temporarily stopping and restarting the image forming operation in steps S21 and S22 may be additionally executed between step S1 and step S2.

In this case, the image forming operation is stopped again in step S3 after the operation in step S2.

In other words, when the detection member D of the system controller 901 detects a failure in the conveyance state of the recording medium, the first operation in step S2 and the second operation in step S3 are executed in sequence. In this case, in the first operation in step S2, the rotation operation of the image bearing member and the intermediate transfer member is temporarily stopped in step S21 and restarted in step S22.

Then, after the rotation operation of the image bearing member and the intermediate transfer member is restarted in step S22, the second operation is executed in step S3, so that the rotation operation of the image bearing member is stopped when a surface of the image bearing member is moved by a predetermined distance through the rotation operation of the image bearing member.

As described above, according to the image forming apparatus 100 of the present exemplary embodiment, capacity of the developer collection box provided in the process cartridge 7 can be minimized, and a jam can be recovered efficiently. In other words, it is possible to provide an image forming apparatus capable of minimizing the amount of toner collected to the toner collection box 14 of the process cartridge 7 at the time of occurrence of a jam.

Further, in the present exemplary embodiment, the processing executed after detection of a jam is controlled by using the predetermined distance L. However, for example, the control may be executed for a predetermined time t corresponding to the predetermined distance L based on the rotation speed of the image bearing member and the intermediate transfer member.

In a second exemplary embodiment, using the image forming apparatus 100 illustrated in FIG. 1 similar to that of the above-described first exemplary embodiment, an operation control executed when a jam is recovered in another example will be described.

<Operation Executed when Jam is Recovered>

The operation to be executed after a jam recovery of a recording medium in the present exemplary embodiment will be described with reference to FIGS. 6, 7A, and 7B.

Figure 6:
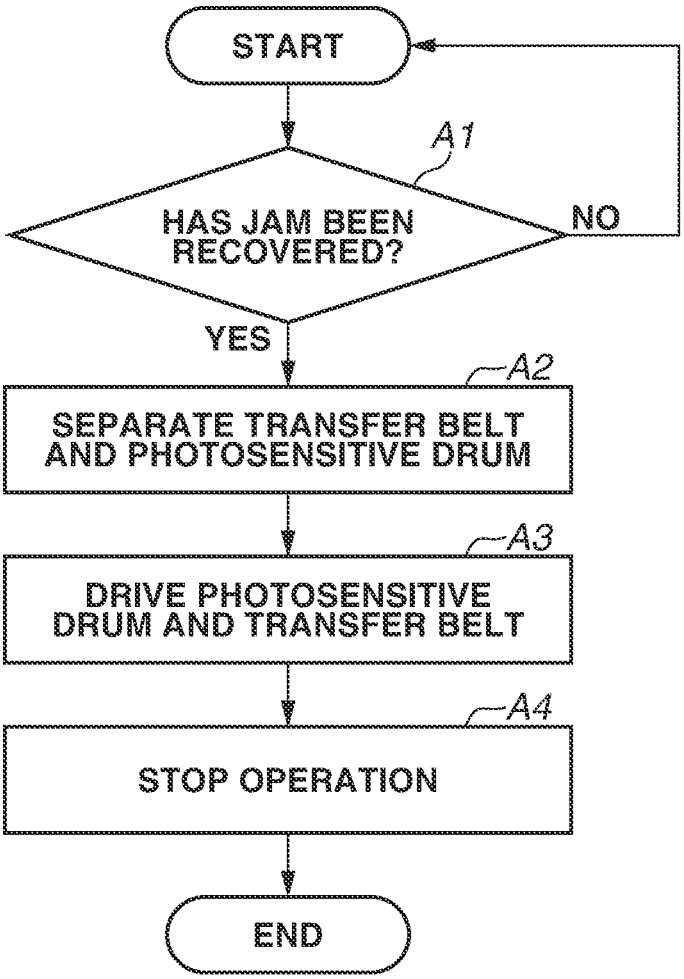
FIG. 6 is a flowchart illustrating control executed when a jam occurring in the image forming apparatus is recovered according to a second exemplary embodiment of the present disclosure.

FIG. 6 is a flowchart illustrating control executed when a jam is recovered in the image forming apparatus 100 according to the present exemplary embodiment of the present disclosure.

As illustrated in FIG. 6, when the image forming operation is being executed, the system controller 901 detects occurrence of a jam (see step S), executes initial operation (see steps S2 and S3). Thereafter, in step A1, the system controller 901 constantly and continuously monitors whether a jam has been recovered.

In step A1, for example, the system controller 901 detects removal of a sheet with the sheet detection sensor 161 (detection member D) to determine that the jam has been recovered.

Specifically, in step A1, the system controller 901 detects a state after the recovery of a jam, in which the above-described operation in steps S2 and S3 is executed, and a sheet is removed from a jammed portion.

After recovery of a jam is detected, in step A2, the transfer member and the photosensitive drum 1 which are in an abutting state are brought into a separation state.

Next, in step A3, the system controller 901 rotationally drives the photosensitive drum 1 and the intermediate transfer belt 31 for the predetermined distance L (or the predetermined time t) to collect toner on the intermediate transfer belt 31 to the cleaning device 11 having the cleaning member 11A and the toner collection box 11B, arranged on the intermediate transfer belt 31.

Then, in step A4, the system controller 901 eventually stops the operation of the image forming apparatus 100.

In addition, a difference between the present exemplary embodiment (second exemplary embodiment) and the first exemplary embodiment will be described with reference to FIGS. 7A and 7B. In the first exemplary embodiment, the separation operation of the intermediate transfer belt 31 and the photosensitive drum 1 in step A2 is not executed, so that the intermediate transfer belt 31 and the photosensitive drum 1 are maintained in an abutting state when the jam recovery operation is executed.

Figure 7A:
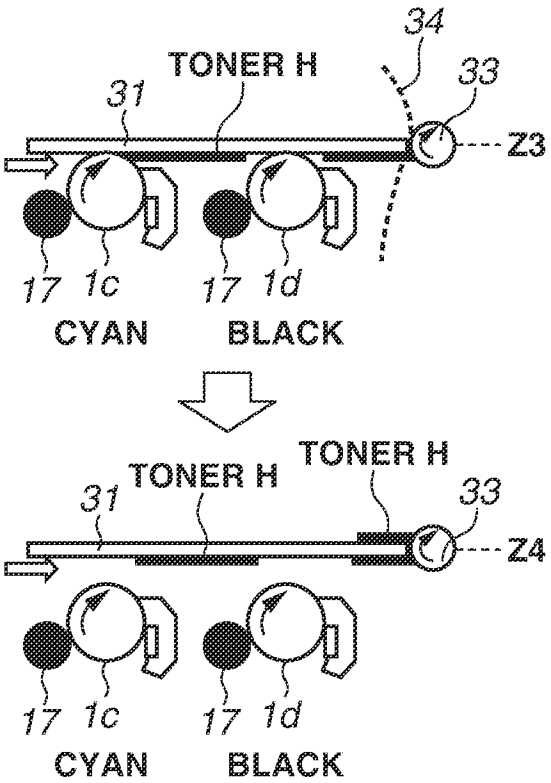
FIGS. 7A and 7B are schematic diagrams illustrating transition states of developer in the image forming apparatus according to the second exemplary embodiment and a reference example (first exemplary embodiment) of the present disclosure.
Figure 7B:
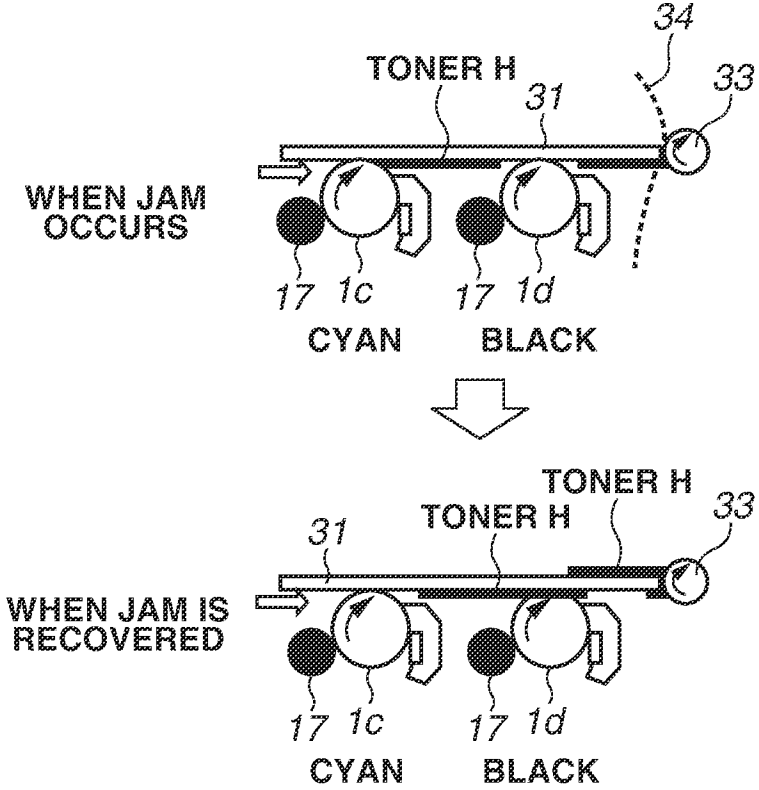

FIG. 7A is a schematic diagram illustrating a transition state of developer in the image forming apparatus 100 according to the present exemplary embodiment of the present disclosure. FIG. 7B is a schematic diagram illustrating a transition state of developer in the first exemplary embodiment as a reference example.

As described above, in the first exemplary embodiment, the jam toner H transferred to the intermediate transfer belt 31 from the upstream station (i.e., the photosensitive drum 1*c*) is left as it is when the jam recovery operation is executed. In a case where the jam toner H is not taken care immediately after occurrence of the jam, the electric charge caused by frictional electrification retained by the jam toner H on the intermediate transfer belt 31 is attenuated. Accordingly, when the jam recovery operation is executed in a state where the intermediate transfer belt 31 is in contact with the photosensitive drum 1, the jam toner H may be retransferred to the photosensitive drum 1. More specifically, even if transfer bias is applied thereto, the jam toner H left on the intermediate transfer belt 31 may be slightly retransferred to the photosensitive drum 1*d* as a downstream station.

In the present exemplary embodiment, the photosensitive drum 1 and the intermediate transfer belt 31 are physically separated when the jam recovery operation is executed. Thus, retransfer of toner occurring in the first exemplary embodiment will not occur. In this way, when the jam recovery operation is executed, toner moved and transferred to the photosensitive drum 1 from the intermediate transfer belt 31 will not be collected to the toner collection box 14 (developer collection chamber) of the process cartridge 7. Accordingly, in comparison to the first exemplary embodiment, the present exemplary embodiment is advantageous in terms of minimization of the capacity of the toner collection box 14 of the process cartridge 7.

Similar to the first exemplary embodiment, according to the present exemplary embodiment, capacity of the developer collection box provided in the process cartridge 7 can be minimized, and a jam can be recovered efficiently.

In a third exemplary embodiment, using the image forming apparatus 100 illustrated in FIG. 1 similar to that of the above-described first exemplary embodiment, another exemplary embodiment will be described with respect to the operation control executed when a jam has occurred.

<Operation Executed When Jam Occurs>

Figure 8:
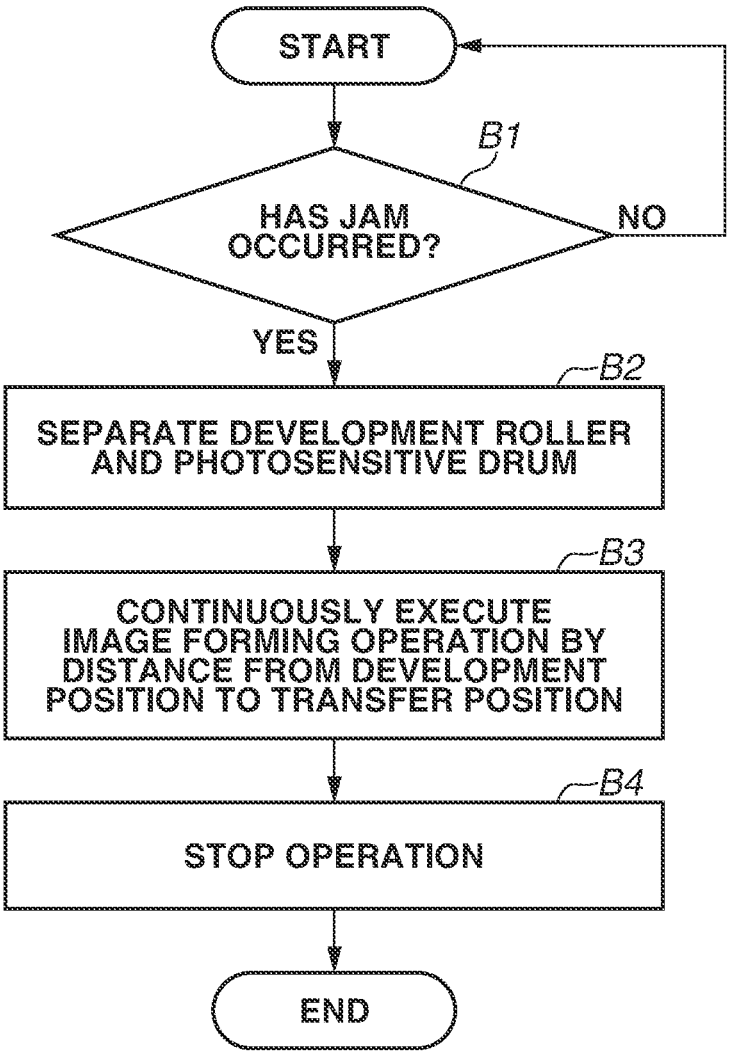
FIG. 8 is a flowchart illustrating control processing executed when a jam occurs in the image forming apparatus according to a third exemplary embodiment of the present disclosure.

An operation control according to the present exemplary embodiment, executed when a jam occurs with a recording medium, will be described with reference to FIG. 8. FIG. 8 is a flowchart illustrating the control executed when a jam occurs with the image forming apparatus 100 according to the present exemplary embodiment of the present disclosure.

In the present exemplary embodiment, in step B1, the system controller 901 constantly and continuously monitors whether a jam occurred during the image forming operation (NO in step B1).

When the system controller 901 detects occurrence of a jam through the detection member D (YES in step B1), the processing proceeds to step B2. In step B2, the system controller 901 separates the development roller 17 and the photosensitive drum 1.

Next, in step B3, the system controller 901 rotationally drives the photosensitive drum 1 and the intermediate transfer belt 31 by a predetermined distance L (or a predetermined time t) to transfer toner on the photosensitive drum 1 to the intermediate transfer belt 31. In the present exemplary embodiment, the predetermined distance L is equivalent to a distance d2 from the development position Y3 to the transfer position Y2 (d2=25 mm).

Then, in step B4, the system controller 901 stops the operation of the image forming apparatus 100.

In comparison to the first exemplary embodiment, the present exemplary embodiment is effective for further reducing an amount of toner consumed in the operation executed when a jam occurs, corresponding to the distance from the exposure portion (exposure position Y1) to the development position Y3.

In other words, in the present exemplary embodiment, the predetermined distance L is longer than or equal to a length of the surface 1*y* of the photosensitive drum 1 in a rotation direction A of the photosensitive drum 1, from the development position Y3 that is in contact with the development roller 17 (developer bearing member) to the transfer position Y2 that is in contact with the intermediate transfer belt 31 (intermediate transfer member), and is shorter than or equal to a distance by which the surface 1*y* of the photosensitive drum 1 is moved in a period when a recording medium is moved from the secondary transfer position Y5 in the secondary transfer roller 33 (secondary transfer member) to the fixing position Y4 in the fixing device 34 (fixing member).

By setting the predetermined distance L within the above-described range, capacity of the developer collection box provided in the process cartridge 7 can be minimized, and a jam can be recovered efficiently. Particularly, a sense of discomfort felt by the user because of occurrence of the jam can be reduced effectively.

Other Exemplary Embodiments

The present disclosure is also applicable to a configuration in which the cleaning member 6 and the toner collection box 14 are not included in the process cartridge 7, and transfer residual toner or fog toner is in contact with the charging roller 2 when image formation is executed.

Further, by executing the control described in the first to the third exemplary embodiments of the present disclosure, it is possible to reduce a contact amount of toner with respect to the charging roller 2 when a jam occurs. With this operation, it is also possible to acquire effect of suppressing toner smudges of the charging roller 2 and omitting control for eliminating toner on the charging roller 2.

The configuration according to the present disclosure can be summarized as follows.

The image forming apparatus 100 according to the present disclosure includes an image bearing member (photosensitive drum 1), a developer bearing member (development roller 17), an exposure member (exposure device 30), an intermediate transfer member (intermediate transfer belt 31), and a cleaning member 11A for cleaning the surface 31*a* of the intermediate transfer member. The developer bearing member can bear developer to be supplied to the image bearing member to develop an electrostatic latent image, and abut on the image bearing member. Furthermore, the exposure device emits light for exposing a surface of the image bearing member to light.

Further, the image forming apparatus 100 includes a secondary transfer member (secondary transfer roller 33) which secondarily transfers a developer image T1 to a recording medium (recording material 35) for recording the developer image T1 from the intermediate transfer member. Further, the image forming apparatus 100 includes a fixing member (fixing device 34) for fixing the developer image T1 transferred to the recording medium by the secondary transfer member. The image forming apparatus 100 further includes a detection member D for detecting a conveyance state of the recording medium and a control unit (system controller 901).

The image bearing member can be rotated, and the developer image T developed from the electrostatic latent image T0 is borne on the surface 1*y* of the image bearing member. Further, the intermediate transfer belt 31 can be rotated, and the intermediate transfer belt 31 is in contact with the surface 1*y* of the image bearing member and bears the developer image T1 transferred from the image bearing member.

When the detection member D detects a failure in a conveyance state of a recording medium, the control unit sequentially executes the first operation (in step S2) and the second operation (in step S3), so that developer (jam toner H) left on the surface of the image bearing member is transferred to the intermediate transfer member from the image bearing member. In the first operation (in step S2), the control unit continuously executes the rotation operation of the image bearing member and the intermediate transfer member without stopping them. Further, in the second operation (in step S3), the control unit stops the rotation operation of the image bearing member when the surface of the image bearing member is moved by the predetermined distance L through the rotation operation of the image bearing member after the failure in the conveyance state is detected.

In the first operation, fixing operation of the fixing member is stopped.

The predetermined distance is longer than or equal to a length of a surface of the image bearing member in a rotation direction of the image bearing member, between (from) the development position Y3 that is in contact with the developer bearing member and (to) the transfer position Y2 that is in contact with the intermediate transfer member, and is shorter than or equal to a distance by which a surface of the image bearing member is moved in a period when a recording medium is moved from the secondary transfer position Y5 in the secondary transfer member to the fixing position Y4 in the fixing member.

With this operation, when a jam occurs, jam toner left on the surface of the image bearing member can be efficiently moved to the intermediate transfer member, so that capacity of the process cartridge used for collecting toner can be reduced accordingly. As a result, capacity of the process cartridge can be minimized, and a jam can be also dealt with. Particularly, it is possible to reduce winding of a sheet to the fixing member when the jam recovery operation is executed.

Further, in the image forming apparatus 100 according to the present disclosure, the predetermined distance L can be longer than or equal to a length of the surface of the image bearing member in the rotation direction of the image bearing member, between (from) the exposure position Y1 and (to) the transfer position Y2.

In particular, the predetermined distance L may be a length d1 of the surface of the image bearing member in the rotation direction A of the image bearing member, between (from) the exposure position Y1 on the surface of the image bearing member, at which exposure is executed by the exposure member, and (to) the transfer position Y2 that is in contact with the intermediate transfer member.

By making the predetermined distance L be longer than or equal to the length d1, toner (jam toner) included in the latent image formed by the exposure member immediately before occurrence of the jam can be thoroughly moved to the intermediate transfer member.

Further, in the image forming apparatus 100 according to the present disclosure, the developer bearing member (development roller 17) may be movable to a first position Z1 at which the developer bearing member can abut on the image bearing member and a second position Z2 at which the developer bearing member can be separated from the image bearing member. The control unit can perform control to move the developer bearing member to the second position Z2 from the first position Z1 in the first operation (in step S2).

In this way, the amount of jam toner newly transferred to the image bearing member from the developer bearing member can be reduced.

Further, in a case where the first operation (in step S2) is executed in a state where the developer bearing member is positioned at the second position Z2, the predetermined distance L can be set as follows.

For example, in the first operation of the image forming apparatus 100 according to the present disclosure, the predetermined distance L can be a length d2 between (from) the development position Y3 and (to) the transfer position Y2 of the surface of the image bearing member in the rotation direction A of the image bearing member.

By setting the predetermined distance L to be the length d2, jam toner left on the image bearing member can be efficiently moved to the intermediate transfer member.

Further, in the image forming apparatus 100 according to the present disclosure, the intermediate transfer belt (intermediate transfer member) 31 may be movable between a third position Z3 at which the intermediate transfer belt 31 can abut on the image bearing member (photosensitive drum 1) and a fourth position Z4 at which the intermediate transfer belt 31 can be separated from the image bearing member. After the second operation in step S3, the control unit can execute a third operation (in steps A2 and A3), in which the intermediate transfer member is positioned at the fourth position Z4, and the image bearing member and the intermediate transfer member are rotated for a predetermined time t (or for a predetermined distance L).

With this operation, toner can be prevented from being reversely transferred to the image bearing member as the downstream station.

Further, in the image forming apparatus 100 according to the present disclosure, the intermediate transfer belt 31 is configured such that an electric potential is applicable, and in the third operation (in steps A2 and A3), the control unit may execute control so that potential of the same polarity as a polarity at the image forming operation for forming an image is applied to the intermediate transfer belt 31.

The above-described control can facilitate the toner transfer to the intermediate transfer belt 31 from the image bearing member.

Further, the image forming apparatus 100 according to the present disclosure may have the developer collection box 11B for storing developer collected from the intermediate transfer belt 31 by the cleaning member 11A.

Further, the image forming apparatus 100 according to the present disclosure can include the process cartridge 7 having the image bearing member (photosensitive drum 1), the second cleaning member (cleaning member)6 that cleans the surface 1*y* of the image bearing member (photosensitive drum 1), and the frame member 13A. Further, the cartridge 7 can be attached to and detached from the apparatus main body 100A of the image forming apparatus 100. The frame member 13A of the process cartridge 7 supports the image bearing member (photosensitive drum 1) and the second cleaning member 6, and forms the developer collection chamber (toner collection box) 14 for storing developer collected from the surface 1*y* of the image bearing member (photosensitive drum 1) by the second cleaning member 6.

Further, in the image forming apparatus 100 according to the present disclosure, the process cartridge 7 may include a second frame member (frame member) 4*a*. Furthermore, the capacity of the developer collection chamber (toner collection box) 14 may be smaller than the capacity of the developer storage chamber (toner storage chamber) 18*b*. In addition, the second frame member 4*a* of the process cartridge 7 may form the developer storage chamber 18*b* for storing developer used for developing an electrostatic latent image formed on the image bearing member (photosensitive drum 1).

The image forming apparatus 100 according to the present disclosure includes an image bearing member (photosensitive drum 1), a developer bearing member (development roller 17), an exposure member (exposure device 30), an intermediate transfer member (intermediate transfer belt 31), and a cleaning member 11A for cleaning a surface 31*a* of the intermediate transfer member. Further, the developer bearing member can bear developer to be supplied to the image bearing member for developing an electrostatic latent image, and abut on the image bearing member. Furthermore, the exposure member emits light for exposing the surface of the image bearing member.

Further, the image forming apparatus 100 includes a secondary transfer member (secondary transfer roller 33) which secondarily transfers a developer image T1 to a recording medium (recording material 35) for recording the developer image T1 from the intermediate transfer member. The image forming apparatus 100 includes a fixing member (fixing device 34) which fixes the developer image T1 transferred to the recording medium by the secondary transfer member. The image forming apparatus 100 further includes a detection member D for detecting a conveyance state of the recording medium and a control unit (system controller 901).

The image bearing member (photosensitive drum 1) can be rotated, and a developer image T1 developed from the electrostatic latent image T0 is borne on the surface 1*y* thereof. Further, the intermediate transfer belt 31 can be rotated, and the intermediate transfer belt 31 is in contact with the surface 1*y* of the image bearing member (photosensitive drum 1) and bears the developer image T1 transferred from the image bearing member (photosensitive drum 1).

When the detection member D detects a failure in a conveyance state of a recording medium, the control unit sequentially executes the first operation (in step S2) and the second operation (in step S3), so that developer (jam toner H) left on the surface of the image bearing member is transferred to the intermediate transfer member from the image bearing member. In the first operation (in step S2), the control unit restarts the rotation operation of the image bearing member and the intermediate transfer member after temporarily stopping the rotation operation thereof. After the rotation operation of the image bearing member and the intermediate transfer member is restarted, in the second operation (in step S3), the rotation operation of the image bearing member is stopped when the surface of the image bearing member is moved by a predetermined distance through the rotation operation of the image bearing member.

The fixing operation of the fixing member is stopped in the first operation.

The predetermined distance is longer than or equal to a length of a surface of the image bearing member in a rotation direction of the image bearing member, from the development position Y3 that is in contact with the developer bearing member to the transfer position Y2 that is in contact with the intermediate transfer member, and is shorter than or equal to a distance by which a surface of the image bearing member is moved in a period when a recording medium is moved from the secondary transfer position Y5 of the secondary transfer member to the fixing position Y4 of the fixing member.

With this operation, when a jam occurs, jam toner left on the surface of the image bearing member can be efficiently moved to the intermediate transfer member, so that capacity of the process cartridge used for collecting toner can be reduced accordingly. In other words, capacity of the process cartridge can be minimized, and a jam can be also dealt with. Particularly, it is possible to reduce winding of a sheet to the fixing member when the jam recovery operation is executed.

As described above, with the image forming apparatus according to the present disclosure, capacity of the developer collection box provided in the process cartridge can be minimized, and a jam can be recovered efficiently. Particularly, it is possible to reduce winding of a sheet to the fixing member when the jam recovery operation is executed.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2019-168210, filed Sep. 17, 2019, and No. 2020-127705, filed Jul. 28, 2020, which are hereby incorporated by reference herein in their entirety.

What is claimed is:

1. An image forming apparatus comprising:

an image bearing member configured to be rotatable and to bear a developer image developed from an electrostatic latent image on a surface of the image bearing member;

a developer bearing member, which is configured to bear developer to be supplied to the image bearing member for developing the electrostatic latent image, and which is configured to be abutable on the image bearing member;

an exposure member configured to emit light for exposing the surface of the image bearing member;

an intermediate transfer member configured to be rotatable, to contact the surface of the image bearing member, and to bear the developer image transferred from the image bearing member;

a cleaning member configured to clean a surface of the intermediate transfer member;

a secondary transfer member configured to secondarily transfer the developer image to a recording medium for recording the developer image, from the intermediate transfer member;

a fixing member configured to fix the developer image transferred to the recording medium by the secondary transfer member;

a detection member configured to detect a conveyance state of the recording medium; and a control unit, wherein, when the detection member detects a failure in the conveyance state of the recording medium, the control unit executes a first operation for continuously executing a rotation operation of the image bearing member and the intermediate transfer member without stopping the rotation operation of either member and, when the surface of the image bearing member is moved by a predetermined distance through the rotation operation of the image bearing member after the failure is detected, the control unit then executes a second operation for stopping the rotation operation of the image bearing member, wherein, in the first operation, a fixing operation of the fixing member is stopped, and the predetermined distance is longer than or equal to a length of the surface of the image bearing member in a rotation direction of the image bearing member, between a development position that contacts the developer bearing member and a transfer position that contacts the intermediate transfer member, and is shorter than or equal to a distance by which the surface of the image bearing member is moved in a period when the recording medium is moved from a secondary transfer position of the secondary transfer member to a fixing position of the fixing member.

2. The image forming apparatus according to claim 1, wherein the predetermined distance is longer than or equal to a length of the surface of the image bearing member in the rotation direction of the image bearing member, between an exposure position where exposure is executed by the exposure member and a transfer position that contacts the intermediate transfer member.

3. The image forming apparatus according to claim 2, wherein the predetermined distance is equal to the length of the surface of the image bearing member in the rotation direction of the image bearing member, between the exposure position and the transfer position.

4. The image forming apparatus according to claim 1, wherein the developer bearing member is configured to be movable to a first position where the developer bearing member abutable on the image bearing member and a second position where the developer bearing member separable from the image bearing member, and wherein the control unit perform control to move the developer bearing member from the first position to the second position in the first operation.

5. The image forming apparatus according to claim 4, wherein, in the first operation, the predetermined distance is a length of the surface of the image bearing member in the rotation direction of the image bearing member, between the development position and the transfer position.

6. The image forming apparatus according to claim 1, wherein the intermediate transfer member is configured to be movable between a third position where the intermediate transfer member is abutable on the image bearing member and a fourth position where the intermediate transfer member is separable from the image bearing member, and wherein, after the second operation, the control unit executes a third operation for moving the intermediate transfer member to the fourth position and rotating the image bearing member and the intermediate transfer member for a predetermined time.

7. The image forming apparatus according to claim 6, wherein the intermediate transfer member is configured such that an electric potential is applicable, and wherein, in the third operation, the control unit executes control so that an electric potential having a same polarity as a polarity at an image forming period for forming an image is applied to the intermediate transfer member.

8. The image forming apparatus according to claim 1, further comprising a developer collection box configured to store developer collected from the intermediate transfer member by the cleaning member.

9. The image forming apparatus according to claim 1, further comprising a cartridge including:

the image bearing member, a second cleaning member configured to clean a surface of the image bearing member, and a frame member which is configured to support the image bearing member and the second cleaning member, and which forms a developer collection chamber for storing developer collected from the surface of the image bearing member by the second cleaning member, wherein the cartridge is attachable to and detachable from an apparatus main body of the image forming apparatus.

10. The image forming apparatus according to claim 9, wherein the cartridge further includes a second frame member which forms a developer storage chamber to store developer for developing an electrostatic latent image on the image bearing member, and wherein capacity of the developer collection chamber is smaller than capacity of the developer storage chamber.

11. An image forming apparatus comprising:

an image bearing member configured to be rotatable and to bear a developer image developed from an electrostatic latent image on a surface of the image bearing member;

a developer bearing member, which is configured to bear developer to be supplied to the image bearing member for developing the electrostatic latent image, and which is configured to be abutable on the image bearing member;

an exposure member configured to emit light for exposing the surface of the image bearing member;

an intermediate transfer member configured to be rotatable, to contact the surface of the image bearing member, and to bear the developer image transferred from the image bearing member;

a cleaning member configured to clean a surface of the intermediate transfer member;

a secondary transfer member configured to secondarily transfer the developer image to a recording medium for recording the developer image, from the intermediate transfer member;

a fixing member configured to fix the developer image transferred to the recording medium by the secondary transfer member;

a detection member configured to detect a conveyance state of the recording medium; and a control unit, wherein, when the detection member detects a failure in the conveyance state of the recording medium, the control unit executes a first operation for restarting a rotation operation of the image bearing member and the intermediate transfer member after temporarily stopping the rotation operation of either member and, when the surface of the image bearing member is moved by a predetermined distance through the rotation operation of the image bearing member after the rotation operation of the image bearing member and the intermediate transfer member is restarted, the control unit then executes a second operation for stopping the rotation operation of the image bearing member, wherein, in the first operation, a fixing operation of the fixing member is stopped, and the predetermined distance is longer than or equal to a length of the surface of the image bearing member in a rotation direction of the image bearing member, between a development position that contacts the developer bearing member and a transfer position that contacts the intermediate transfer member, and is shorter than or equal to a distance by which the surface of the image bearing member is moved in a period when the recording medium is moved from a secondary transfer position of the secondary transfer member to a fixing position of the fixing member.

* * * * *